US006694117B2

(12) United States Patent
Wakamatsu et al.

(10) Patent No.: US 6,694,117 B2
(45) Date of Patent: Feb. 17, 2004

(54) COLOR PHOTOGRAPHIC APPARATUS

(75) Inventors: Kazuhiro Wakamatsu, Hitachi (JP); Makoto Otaka, Hitachi (JP); Tetsunori Kaneko, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/246,711

(22) Filed: Sep. 19, 2002

(65) Prior Publication Data

US 2003/0081966 A1 May 1, 2003

(30) Foreign Application Priority Data

Oct. 30, 2001 (JP) ..... 2001-331841

(51) Int. Cl.[7] ..... G06G 15/01
(52) U.S. Cl. ..... 399/228; 399/223
(58) Field of Search ..... 399/223, 228, 399/234, 265, 279, 119, 222

(56) References Cited

U.S. PATENT DOCUMENTS 4,891,674 A * 1/1990 Seyfried ..... 399/228
4,922,300 A * 5/1990 Sasaki et al. ..... 399/223 X
5,132,733 A * 7/1992 Koizumi et al. ..... 399/228
5,182,584 A * 1/1993 Fukunaga et al. ..... 399/223 X
5,412,457 A * 5/1995 Kawano et al. ..... 399/228
5,440,377 A * 8/1995 Izawa et al. ..... 399/223 X
5,495,327 A * 2/1996 Inomata ..... 399/228
5,749,031 A * 5/1998 Miwa et al. ..... 399/228

FOREIGN PATENT DOCUMENTS

JP 05-066660 * 3/1993
JP 2001-083801 * 3/2001

* cited by examiner

*Primary Examiner*—Sandra Brase
(74) *Attorney, Agent, or Firm*—Antonelli, Terry, Stout & Kraus, LLP

(57) ABSTRACT

A color electrophotographic apparatus eliminates necessity of mechanism for urging the developer from the front side. The developer is placed away from a photo conductor. On both sides of the developer, mutually cooperated gears are provided. One of the gear meshes with a drive gear with a clutch for driving the developer. The other gear is meshed with a brake gear coupled with a brake mechanism whose brake function can be turned On and OFF by an electric signal. The drive gear is arranged to urge the developer onto the photo conductor by rotation thereof. When the gear of the developer rotates, the brake gear is arranged at a position to urge the developer onto the photo conductor. The torque to start slippage of the brake is set at a value to be greater than a force of a spring pushing back the developer.

7 Claims, 4 Drawing Sheets

COLOR PHOTOGRAPHIC APPARATUS

BACKGROUND OF THE INVENTION

The present invention relates to an electrophotographic apparatus for obtaining full color image.

As can be seen from Japanese Patent Application Laid-Open No. 5-66660(1993), the conventional color printer is provided with a cam and its drive mechanism for selectively urging a developer onto a photo conductor within a lid to be opened and closed upon exchanging the developer.

On the other hand, as can be seen from Japanese Patent Application Laid-Open No. 2001-83801, a shaft with two gears for driving the developer is provided below the developer to mesh these gears with gears on both sides of the developer for biasing the developer onto the photo conductor by rotation of the shaft.

In Japanese Patent Application Laid-Open No. 5-66660 (1993), since the cam and its drive mechanism for urging the developer onto the photo conductor are provided within the lid, the lid inherently becomes complicate and heavy.

On the other hand, in the example illustrated and disclosed in Japanese Patent Application Laid-Open No. 2001-83801, since the shaft is provided below the developer, an interval between the developers has to be wide enough to make a height of a printer body high.

SUMMARY OF THE INVENTION

The present invention has been worked out for solving the problem set forth above. Therefore, it is an object of the present invention to provide a color electrographic apparatus which can simplify a structure and reduce weight of as lid and can reduce necessary height of a printer body.

According to the first aspect of the present invention, a color electrophotographic apparatus having a photo conductor and a plurality of detachable developers, comprises:

rotation transmitting means provided on both sides of each of the developers and cooperated with each other, for transmitting rotational force, one of the rotation transmitting means driving the developer; and a brake mechanism controllable for turning ON and OFF the other rotation transmitting means.

In the preferred construction, the brake mechanism starts slippage at a predetermined torque or force.

According to the second aspect of the present invention, a color electrophotographic apparatus having a photo conductor and a plurality of detachable developers, comprises:

gears provided on both sides of each of the developers and cooperated with each other, rotation transmitting means meshed with one of the gears, for driving the developer, another rotation transmitting means having a brake mechanism starting slippage at a predetermined torque or force and meshing with the other gear one of the rotation transmitting means driving the developer; and the brake mechanism being controllable for turning ON and OFF the another rotation transmitting means.

The brake mechanism may be turned ON when the developer is contacted with the photo conductor, the brake mechanism is turned OFF when developer is released away from the photo conductor. The brake mechanism may be positioned below the developer According to the third aspect of the present invention, a color electrophotographic apparatus having a photo conductor and a plurality of detachable developers, comprises:

rotation transmitting means provided on both sides of each of the developers and cooperated with each other, for transmitting rotational force, one of the rotation transmitting means driving the developer; and a brake mechanism starting slippage at a predetermined torque or force being provided in the other rotation transmitting means, the brake mechanism being mounted on the developer.

The rotation transmitting means may include at least one or more gears.

The developer is placed away from the photo conductor. On both sides of the developer, mutually cooperated gears are provided. One of the gear meshes with the drive gear with a clutch for driving the developer. The other gear is meshed with a brake gear coupled with a brake mechanism whose brake function can be turned On and OFF by control means, such as electric signal. The drive gear is arranged to urge the developer onto the photo conductor by rotation thereof. When the gear of the developer rotates, the brake gear is arranged at a position to urge the developer onto the photo conductor. The torque to start slippage of the brake is set at a value to be greater than a force of a spring pushing back the developer.

It should be noted that the gears on both sides of the developer, the drive gear and the brake gear may be replaced with a combination of the gear and the timing belt or other rotation transmitting means.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENTS

Figure 1:
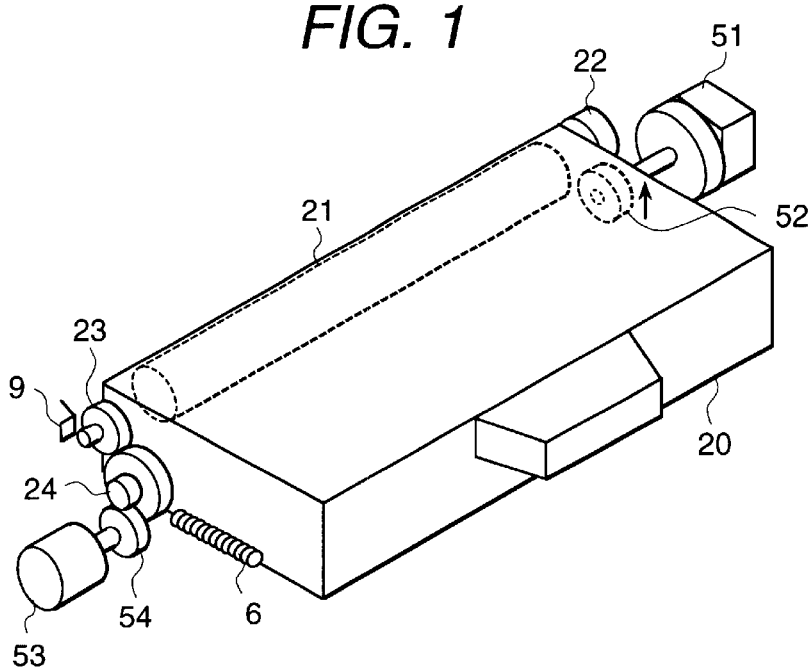
FIG. 1 is a perspective view of a developer and a drive system to be employed in the first embodiment of a color electrographic apparatus according to the present invention.

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structure is not shown in detail in order to avoid unnecessary obscurity of the present invention.

Upon initiation of development in the present invention, power is supplied to a clutch and a brake device to start rotation of a drive gear. At the same time, a brake is applied to a brake gear. A gear of a developer meshing with the drive gear is urged by the drive gear. Thus, the developer on the side of the drive gear is urged onto a photo conductor. When urging of the developer onto the photo conductor is completed, a drive torque becomes greater than a load torque of the developer to drive rollers of the developer for rotation. At this time, when the brake is applied to the brake gear meshing with the other gear of the developer, the developer on the side of the brake gear is also urged onto the photo conductor by rotation of the gear on the side of the drive gear of the developer. When urging of the developer onto the photo conductor is completed, brake starts to slip to cause rotation of the brake gear. Thus, overall developer roller rotates maintaining contact with the photo conductor to start development.

When development is completed, the clutch connected to the drive gear is stopped. At substantially the same time, the brake is released. Then, by action of a spring to return the developer, the drive gear and the brake gear are rotated in reverse direction to release the developer away from the photo conductor.

Hereinafter, the preferred embodiments of the present invention will be discussed in terms of a color laser printer as a color electrophotographic apparatus with reference to the accompanying drawings.

A transfer drum 2 is mounted at a center portion of a printer body 1. A photo conductor belt cartridge 10 is provided in front of the transfer drum 2 (right side of FIG. 2). Within the photo conductor belt cartridge 10, a photo conductor belt 11 is held by a roller. On the front side of the photo conductor belt cartridge 10, four developers 20K, 20Y, 20M and 20C are mounted, which developers will be hereinafter generally referred to as developer 20. Below the developer 20, a laser unit 5 is provided. Furthermore, below the laser unit 5, a paper cassette 31 is provided. On backside (left side of FIG. 2) of the paper cassette 31, a paper feeding roller 33 and a registration roller 34 are arranged. Above the transfer drum 2, a drum cleaner 3 is provided. On the backside of the transfer drum 2, a transfer roller 35, a static eliminator 36, a fixing device 37 and a paper discharge roller 38 are arranged. On an upper surface of the printer body 1, a paper discharge tray 39 is formed.

The developer 20 is movable back and forth along a rail 8 (see FIG. 4) provided in the printer body 1. A stopper 9 is formed at a tip end of the rail 8 for maintaining contact between the developer 20 and the photo conductor belt 11 constant. Springs 6 are mounted on left and right sides of the developer 20. Upon installing the developer 20, respective one ends of the springs are biased from the printer body 1 for biasing the developer 20 away from the photo conductor belt 11 with a force of about 8N, respectively.

On the front side of the printer body 1, a front door 41 is provided. On the lower side of the front door 41. a rotary shaft 44 is provided so as to be opened upon exchanging the developer 20.

As shown in FIG. 1, at the tip end of the developer 20, a developer roller 21 is mounted. On both ends of the developer roller 21, gears 22 and 23 are provided.

The gear is mounted for meshing with a drive gear 52 provided on right side of the printer body 1. In addition to the drive gear 52, the gear 22 meshes with a gear for driving vanes for supplying toner in the developer 20 to the developer roller 21. However, detailed discussion for the system for supplying toner to the developer roller 21 will be eliminated from the disclosure since such system is irrelevant to the subject manner of the present invention.

An idler gear 24 as two stage gears having gear ratio of 2:1, rotation speed of the idler gear 24 and the brake gear 54 is half.

A load torque of the developer 20 is about 0.25 Nm. Pitch circle diameter of each gear, 22, 23 and the brake gear 54 is 20 mm.

The drive gear 52 is mounted a clutch 51 for controlling rotation of the developer 20.

The brake 54 is mounted on the left side of the printer body 1 via an electromagnetic brake 53. The electromagnetic brake 53 is set to start to slip at a torque of 0.1 Nm The drive gear 52, the clutch 51, the electromagnetic brake 53 and the brake gear 54 are provided for each developer 20K, 20C, 20M and 20Y.

Figure 2:
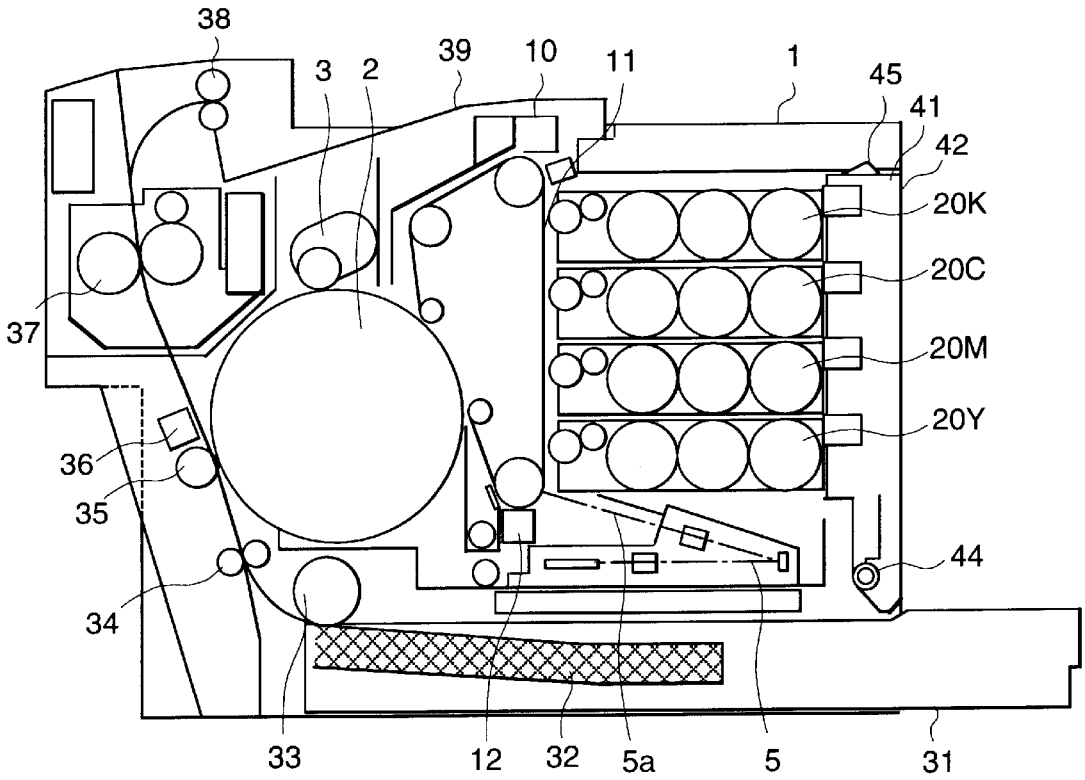
FIG. 2 is a longitudinal section of a printer as the first embodiment of the color electrographic apparatus.
Figure 3A:
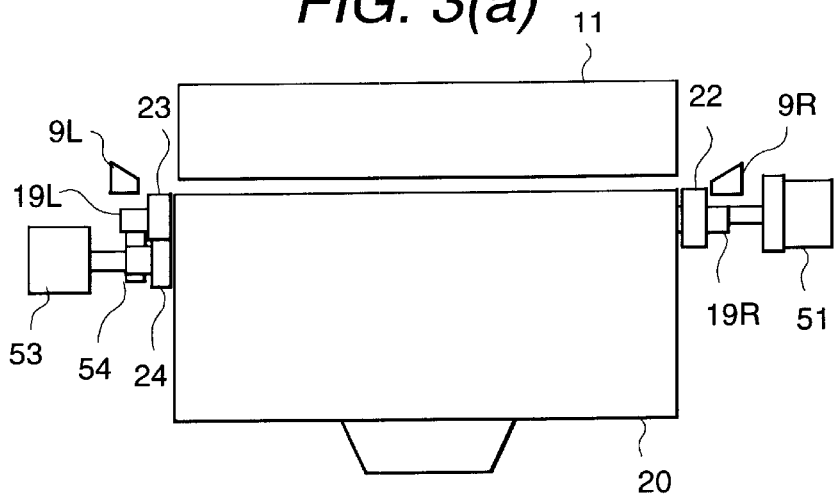
FIGS. 3A, 3B and 3C are explanatory illustrations showing an operation of the developer.
Figure 3B:
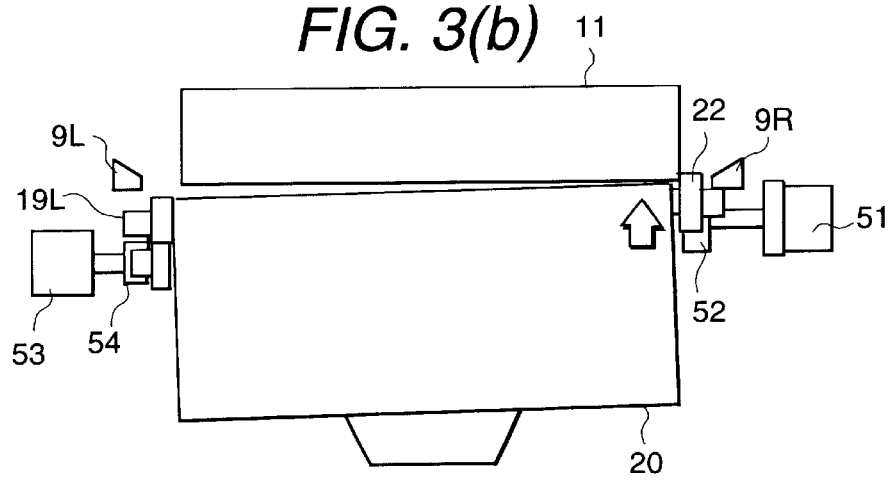
Figure 3C:
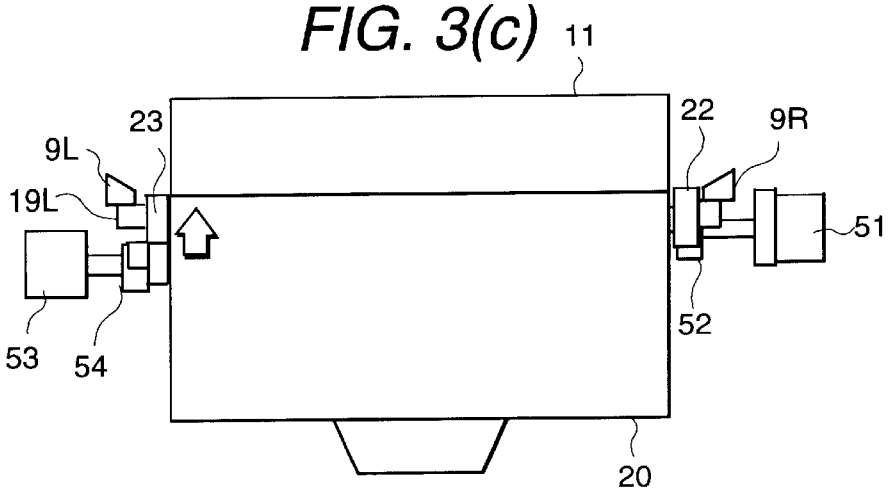

Here, operation of the color laser printer will be discussed with reference to FIGS. 3A to 3C together with FIGS. 1 and 2.

When printing is initiated, rotation of the photo conductor belt 11 is started. Associating with this, the transfer drum 2 starts rotation at a constant speed. The photo conductor belt 11 is uniformly charged by a charger 12. The laser unit 5 emits a laser beam 5*a* according to an image signal of each color. By this, electrostatic latent images corresponding to respective colors are formed sequentially on the surface of the photo conductor belt 11. Formation of the latent images are performed in sequentially order of block K, cyan C, magenta M and yellow Y.

When the electrostatic latent image of black reaches the position of the developer 20K, an electric color is supplied to the clutch 51. Then, the drive gear 52 starts rotation in counterclockwise direction (as viewed from left side of the printer). The gear 22 on the right side of the developer 20 is urged toward the photo conductor belt 11 by the drive gear 52. At this time, since the load torque of the developer roller 21 is 0.25 Nm, when a force of 25N acts on tooth top of the brake gear 22, the developer roller 21 starts rotation. However, since this force is greater than a force of 8N of the spring 6 for pushing back the developer 20, the developer 20 is urged onto the photo conductor belt 11 on right side before the developer roller 21 starts rotation. As shown in FIG. 3B, when a developer bearing 19R is urged onto a stopper 9R, the drive torque becomes greater than the load torque of 0.25 Nm of the developer roller 21. Thus, the developer roller 21 starts rotation.

On the other hand, substantially at the same time with power supply to the clutch 51, power supply to the electromagnetic brake 53 is started to fix the brake gear 54 by braking action. When the developer roller 21 is rotated, the gear 23 on the left side is rotated to act in a direction for rotating the brake gear 54. However, since a set value of the electromagnetic brake 53 is 0.1 Nm, the electromagnetic brake 53 will not slit until a force of 10N acts on the teeth top of the brake gear 54. Since this force is grater than the force of 8N of the spring 6 pushing back the developer 20, the left side of the developer 20 starts to move toward the photo conductor belt 11. Namely, as shown in FIG. 3C, when a developer bearing 19L is urged onto the stopper 9L, the electromagnetic brake 53 starts to slip to rotate the brake gear 54. As a result, the overall developer roller 21 rotates maintaining contact with the photo conductor belt 11 to start development.

Summarizing action of contact between developer 20 and the photo conductor belt 11, at first the right side of the developer 20 contacts with the photo conductor belt 11, and with slight delay, the left side of the developer 20 contacts with the photo conductor belt 11. A delay period, in the shown embodiment, is 0.02 seconds when rotation speed of the idler gear 24 meshing with the brake gear 54 is 150 rpm and moving distance of the developer 20 is 3 mm, which delay period will never cause significant problem in developing operation of the electrostatic latent image.

As set forth above, the developer 20K develops the electrostatic latent image on the photo conductor belt 11 to form a black toner image on the photo conductor belt 11.

When the black electrostatic latent image passes through the developing position, power supply to the clutch 51 and the electromagnetic brake 53 is stopped to extinguish force biasing the developer 20 toward the photo conductor belt 11. Therefore, by action of the spring 6 for pushing back the developer 20, the drive gear 52 and the brake gear 54 are rotated in reverse direction to move the developer 20 away from the photo conductor belt 11.

On the other hand, the transfer belt 2 is in rotation with maintaining contact with the surface of the photo conductor belt 11 in synchronism therewith. However, due to potential difference between the photo conductor belt 11 and the transfer drum 2, the black toner image on the surface of the photo conductor belt 11 is transferred to the surface of the transfer drum 2.

Subsequent to black, an electrostatic latent image of cyan C is formed on the photo conductor belt 11. Similar to the case of black, an electric power is supplied to the clutch 51C and the electromagnetic brake 53C of cyan. Then, the developer 20C contacts with the photo conductor belt 11. By the developer 20C, the electrostatic latent image is developed into a cyan toner image to form the cyan toner image on the photo conductor belt 11. Then, the cyan toner image is also transferred from the photo conductor belt 11 onto the transfer drum. By repeating the same processes for magenta and yellow, four color toner images are formed on the surface of the transfer drum 2.

On the other hand, paper 32 as printing media stacked in a paper cassette 31 is extracted and transported by a paper feeder roller 33 to a register roller 34 for matching control of the color toner image on the surface of the transfer drum 2 and a paper feeding timing. Thereafter, the paper 32 is fed to the transfer roller 35.

The transfer roller 35 transfers the color toner image on the surface of the transfer drum 2 to the paper 32 by applying a mechanical depression force and a transfer field from back surface of the paper 32 with maintaining contact between the fed paper 32 and the transfer drum 2. It should be noted that the transfer roller 35 is retracted away from the photo conductor belt 11 by a transfer roller driving device (not shown) so as not to contact with the color toner image during a process for forming the color toner image by transferring respective colors of toner images on the photo conductor belt 11 onto the surface of the transfer drum 2. After completion of formation of the color toner image, the transfer roller 35 is urged onto the transfer drum 2 for depressing the paper 32 as the printing medium onto the transfer drum 2 for transferring the color toner image.

An AC eliminator 36 generating an AC corona by application of an alternating current voltage from a power source for AC eliminator (not shown) neutralizes a residual charge on the back surface of the paper transferred the color toner image for elimination to facilitate peeling of the paper 32 from the transfer drum 2.

The paper 32 peeled from the transfer drum 2 is fed to a fixing device 37. While passing through the fixing device 37, the color toner image is fixed on the surface of the paper 32 by heat fusing. The paper heat fused the color toner image is discharged on a discharge tray 39 through a discharge roller 38.

The drum cleaner 3 cleans up the toner residing on the surface of the transfer drum 2. The drum cleaner 3 is pulled up from the transfer drum 2 so as not to act for cleaning during a process where the mono-color image is transferred to the surface of the transfer drum 2 for forming the color toner image. After completion of the color toner image, and after transfer of the color toner image to the paper 32, the drum cleaner 3 becomes active for clean up the surface of the transfer drum 2.

When the toner in the developer 20 spent out, the developer 20 is to be exchanged by new one. Upon exchanging, the front door 41 on the front side of the printer body 1 is opened to withdraw the developer 20 and to insert the new developer 20. In the front door 41, the cam and so forth urging the developer as in the conventional printer is not provided.

As set forth above, with the shown embodiment, utilizing own rotating force, the developer contacts with the photo conductor. Therefore, it is not required the mechanism for urging the developer from the front side thereof any more.

Furthermore, since it becomes unnecessary to extend the shaft below the developer, height of the printer body can be reduced.

In addition, while the developer roller 21 is driven to rotate for development, the electromagnetic brake 53 is rotated with slipping to generate a frictional heat within the electromagnetic brake 53. In the shown embodiment, two stage idler gear 24 is mounted for setting the gear ratio at 2:1. Therefore, in comparison with the case where the idler gear is not provided, rotation speed of the electromagnetic brake 53 becomes half to make generated heat amount half. Therefore, the shown embodiment achieves reduction of the generated heat amount in the electromagnetic brake portion by reducing the rotation speed of the electromagnetic brake.

The second embodiment of the present invention will be discussed with reference to FIG. 4.

Figure 4:
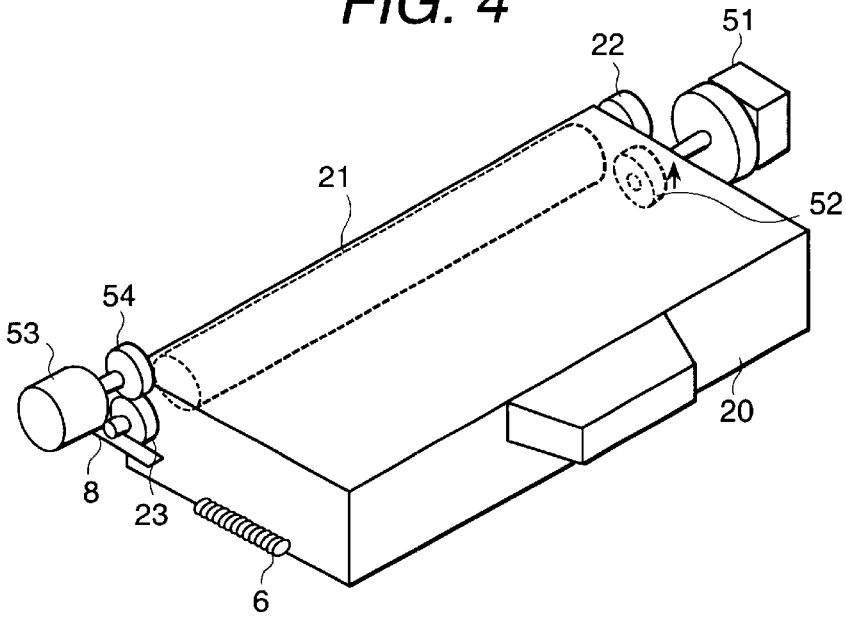
FIG. 4 is a perspective view of a developer and a drive system to be employed in the second embodiment of a color electrographic apparatus according to the present invention.

FIG. 4 is a perspective view of a part of the developer and a drive system as viewed left front side.

In the shown embodiment, a gear 23 is mounted on the left side of the developer roller 21. On the other hand, above the gear 23, an electromagnetic brake 53 and the brake gear 54 are arranged so that the gear 23 and the brake gear 54 are directly meshed (without interposing the idler gear). The electromagnetic brake 53 is mounted on the left side of the printer body 1.

The operation of the color laser printer is the same as the foregoing first embodiment of the present invention. Therefore, discussion of the operation of the second embodiment of the color laser printer will be eliminated for avoiding redundant discussion for keeping the disclosure simple enough to facilitate clear understanding f the present invention.

In the shown embodiment, in comparison with the first embodiment, since the idler gear 24 is not arranged, rotation transmission part can be reduced correspondingly.

On the other hand, since the rotation speed of the gear 23 meshing with the brake gear 54 is 300 r.p.m., a delay period from a timing where the right side of the developer 20 contacts with the photo conductor belt 11 to a timing where the left side of the developer 20 contact with the photo conductor belt 11, can be shortened as short as 0.01 second (half of the first embodiment).

As set forth above, with the shown embodiment, number of the rotation transmission parts can be reduced, and a delay period to the timing where the brake gear wide of the developer contact with the photo conductor, can be shortened.

The third embodiment of the present invention will be discussed with reference to FIG. 5.

Figure 5:
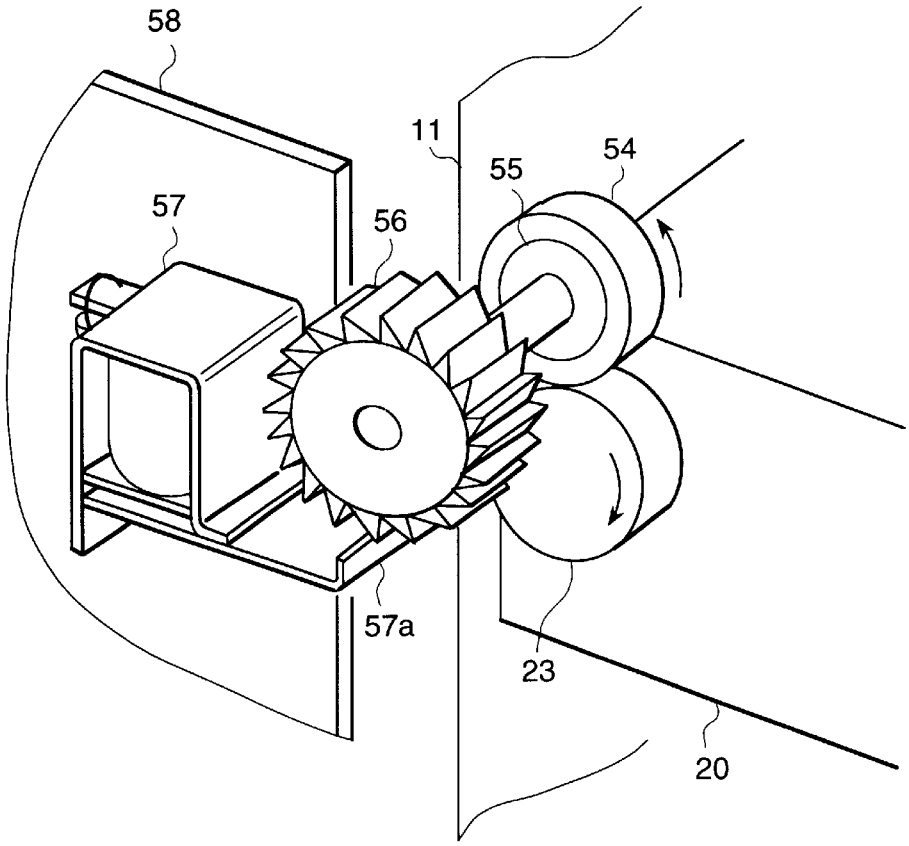
FIG. 5 is a perspective view of a major part of the third embodiment of a color electrographic apparatus according to the present invention.

FIG. 5 is a perspective view showing periphery portion of the brake gear.

In the shown embodiment, a torque limiter 55 for causing slippage at about 0.1 Nm is provided in the brake gear 54. To the brake gear 54, a ratchet 56 is provided coaxially. A solenoid 57 having an engaging claw 57*a* engaging with the ratchet 56, is provided. The solenoid 57 is directly mounted on a control substrate 58.

At the same time of supplying power to the clutch 51, power is also supplied to the solenoid 57. The solenoid 57 pulls the claw 57*a* to engage the claw 57*a* with the ratchet 56 to stop rotation of the ratchet 56. When the gear 23 of the developer 20 starts, the developer is moved toward the photo conductor belt 11. When the developer 20 contacts with the photo conductor belt, the torque limiter 55 starts to slip. Then, the gear 23 and the brake gear 54 are rotated as shown by arrow for performing development.

When development is completed, power supply to the solenoid 57 is stopped to release the claw 57*a* from the ratchet 56. The, the ratchet 56 and the brake gear 54 are rotated in clockwise direction by action of the spring 6 to place the developer 20 away from the photo conductor 11.

The same effect can be obtained even when the torque limiter 55 is provided within the ratchet 56.

On the other hand, as in the first embodiment, it is also possible to arrange the idler gear 24 for reducing rotation speed of the brake gear 54, to mesh with the brake gear 54 built-in the torque limiter 56. In such case, the orientation of the ratchet 56 has to be reversed from the foregoing embodiment. In this case, generated heat amount in the torque limiter can be reduced.

With the shown embodiment, by directly mounting the solenoid to the substrate, assembling ability can be improved.

Figure 6:
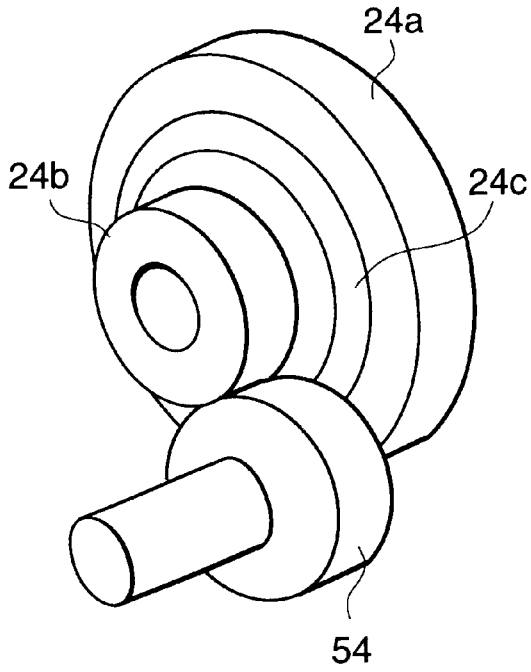
FIG. 6 is a partial perspective view a major part of the fourth embodiment of a color electrographic apparatus according to the present invention.

Next, the fourth embodiment of the present invention will be discussed with reference to FIG. 6.

The shown embodiment is the modification of the first embodiment. As shown in FIG. 6, within the idler gear 24 constituted with a larger diameter gear 24*a* and a smaller diameter gear 24*b*, a torque limiter 24*c* causing slippage at a predetermined torque or force, is provided. Also, a brake mechanism causing slippage at a given torque or force is arranged on the side of he developer 20.

On the other hand, the mechanism on the side of the printer body 1 to be coupled with the brake gear 54 is constructed by mounting the ratchet 56 on the shaft fixed thereon the brake gear 54. The ratchet 56 is fixed during development by the solenoid 57 or so forth. After completion of development, the ratchet 56 is made free.

In the shown embodiment, by providing the torque limiter 24*c* is provided in the developer 20 which is to be exchanged as consumable supplies, a parts lift time of the torque limiter 24*c* can be set to be comparable with an exchange period of the developer 20. Typically, the life time of the printer body is set to be several tens times of the exchange period of the developer 20. Therefore, in comparison with the case where the torque limiter is arranged on the side of the printer body, the lift time of the torque limiter 24*c* can be one several tenth. Thus, correspondingly inexpensive material and parts can be used.

Figure 7:
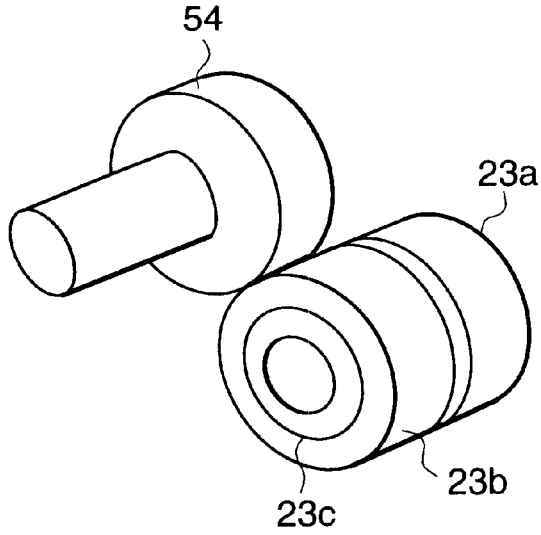
FIG. 7 is a partial perspective view a major part of the fifth embodiment of a color electrographic apparatus according to the present invention.

The fifth embodiment of the present invention will be discussed with reference to FIG. 7.

The shown embodiment is the modification of the second embodiment. As shown in FIG. 7, the gear 23 is a double gear construction, in which the outer side gear 23*b* meshes with the brake gear 54. Within the outer side gear 23*b*, the torque limiter 23*c* which causes slip at a given torque or force, is provided. The inner side gear 23*a* is directly coupled with a shaft of the developer roller 21 without providing the torque limiter 23*c*.

In the shown embodiment, the gear 23 is formed as double gear construction for arranging the brake mechanism to cause slippage at a given torque or force is arranged on the side of the developer 20. By such construction, (1) the brake force for urging the developer 20 onto the photo conductor belt 11 is generated by the outer side gear 23*b* and the torque limiter 23*c*, and (2) the inner side gear 23*a* is constructed not to cause slippage to transmit driving force to a reset roller and so forth in the developer.

On the other hand, the mechanism on the side of the printer body 1 coupled with the brake gear 54 may be provided with the similar construction as the fourth embodiment set forth above.

In the shown embodiment, similarly to the fourth embodiment, in comparison with the case where the torque limiter is arranged on the side of the printer body, the life time of the torque limiter 23*c* can be set one several tenth. Correspondingly, the inexpensive material or component can be used.

It should be noted that, in the foregoing first to fifth embodiment, the gears 22 and 23 on both sides of the developer roller 21, the drive gear 53, the brake gear 54 can be a combination of gear and timing belt (cogged belt) or other rotation transmitting means.

On the other hand, in the first to fifth embodiment, even when the brake mechanism having a function to cause slip in response to the torque or force and being capable of ON/OFF control, a step of turning ON the brake mechanism to urge the developer onto the photo conductor can be implemented.

In this case, in the next developing step, the brake mechanism is turned OFF immediately after contacting the developer onto the photo conductor and adds a mechanism to (1) eliminate or weaken the spring force on the side of the brake and to (2) maintain contact against the spring force.

With the present invention, a mechanism for urging the developer from the front side becomes unnecessary. Also, compact color electrophotographic apparatus can be constructed.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. A color electrophotographic apparatus having a photo conductor and a plurality of detachable developers, comprising:

rotation transmitting means provided on both sides of each of said developers and cooperated with each other, for transmitting rotational force, one of said rotation transmitting means driving said developer; and a brake mechanism controllable for turning ON and OFF the other rotation transmitting means.

2. A color electrophotographic apparatus as set forth in claim 1, wherein said brake mechanism starts slippage at a predetermined torque or force.

3. A color electrophotographic apparatus having a photo conductor and a plurality of detachable developers, comprising:

gears provided on both sides of each of said developers and cooperated with each other, rotation transmitting means meshed with one of said gears, for driving said developer, another rotation transmitting means having a brake mechanism starting slippage at a predetermined torque or force and meshing with the other gear one of said rotation transmitting means driving said developer; and said brake mechanism being controllable for turning ON and OFF said another rotation transmitting means.

4. A color electrophotographic apparatus as set forth in claim 3, wherein said brake mechanism is turned ON when said developer is contacted with said photo conductor, said brake mechanism is turned OFF when developer is released away from said photo conductor.

5. A color electrophotographic apparatus as set forth in claim 3, wherein said brake mechanism is positioned below said developer.

6. A color electrophotographic apparatus having a photo conductor and a plurality of detachable developers, comprising:

rotation transmitting means provided on both sides of each of said developers and cooperated with each other, for transmitting rotational force, one of said rotation transmitting means driving said developer; and a brake mechanism starting slippage at a predetermined torque or force being provided in the other rotation transmitting means, said brake mechanism being mounted on said developer.

7. A color electrophotographic apparatus as set forth in claim 6, wherein said rotation transmitting means includes at least one or more gears.

* * * * *